US012158285B2

(12) United States Patent
Crosby

(10) Patent No.: US 12,158,285 B2
(45) Date of Patent: Dec. 3, 2024

(54) APPARATUS FOR IMPROVING AIR QUALITY IN A BUILDING

(71) Applicant: INMICRO Indoor Air Inc., West Vancouver (CA)

(72) Inventor: Bruce Kelly Crosby, West Vancouver (CA)

( * ) Notice: Subject to any disclaimer, the term of this patent is extended or adjusted under 35 U.S.C. 154(b) by 806 days.

(21) Appl. No.: 17/216,434

(22) Filed: Mar. 29, 2021

(65) Prior Publication Data

US 2021/0302035 A1 Sep. 30, 2021

Related U.S. Application Data

(60) Provisional application No. 63/000,574, filed on Mar. 27, 2020.

(51) Int. Cl.

| | |
|---|---|
| ***F16L 11/00*** | (2006.01) |
| ***F16L 17/00*** | (2006.01) |
| ***F16L 21/00*** | (2006.01) |
| ***F24F 3/16*** | (2021.01) |
| ***F24F 8/24*** | (2021.01) |

(52) U.S. Cl.
CPC . *F24F 8/24* (2021.01); *F24F 3/16* (2013.01)

(58) Field of Classification Search
CPC ..... F24F 8/24; F24F 3/16; F24F 2006/008
USPC ..... 138/114; 285/32, 123.1, 179
See application file for complete search history.

(56) References Cited

U.S. PATENT DOCUMENTS

| | | | | |
|---|---|---|---|---|
| 2,438,129 | A * | 3/1948 | Hyman | A24F 25/02 239/59 |
| 4,477,414 | A * | 10/1984 | Muramoto | B01D 1/00 261/95 |
| 2010/0038452 | A1* | 2/2010 | Lin | B65D 83/262 239/304 |
| 2017/0173203 | A1* | 6/2017 | Becker | A61L 9/12 |
| 2018/0318462 | A1* | 11/2018 | Bourne | A61L 9/00 |

* cited by examiner

*Primary Examiner* — Monzer R Chorbaji

(57) ABSTRACT

A diffuser to distribute vapors throughout a building using an HVAC system. The diffuser has an inner tube with vents and a rotatable outer tube with vents, being rotatable by a rotation mechanism. The vents on both tubes can be misaligned, or fully or partially aligned by rotation of outer tube. The inner tube has a connector at one end to removably connect to a liquid container, and an annular flange. An elbow is located between the connector and the flange such that the container may be oriented vertically when the tubes are horizontal. A cavity in the inner tube is open to the container, and a wick in the cavity transmits liquid from the container to the cavity. Vapor diffuses out of the cavity through the vents when they are at least partially aligned. The diffuser may be installed into an HVAC duct.

18 Claims, 6 Drawing Sheets

APPARATUS FOR IMPROVING AIR QUALITY IN A BUILDING

FIELD OF THE INVENTION

The present invention relates to an apparatus for improving the air quality in buildings, hospitals, schools, cruise ship and other large, enclosed spaces, and more particularly to an apparatus for diffusing a vapor from a liquid into an air space of said buildings, hospitals, schools, cruise ship and other large, enclosed spaces.

BACKGROUND

The quality of the air supply of indoors can often be contaminated with microbes that mix with the air and inhaled by the occupants. Bioaerosols and their fragments, ultra-fine particles of diameter less than 0.01 mm are easily and deeply ingested into the lungs. Such particles can cause damage to the lungs and disease. These particles include bacteria virus and mold known as the indoor microbiome Some are pathogenic and cause illnesses in humans. Of particular recent concern are the coronaviruses such as COVID-19, SARS-CoV-2, MERS-CoV as well as others.

Poor indoor air quality is responsible for a number of health problems, collectively known as Sick Building Syndrome. Such health problems include dryness and irritation of the eyes, nose and throat; difficulty concentrating on mental tasks; headache, fatigue and drowsiness; shortness of breath, itchy and dry skin; hypersensitivity and allergies. Illnesses from building related causes frequently affect the respiratory system. Flu-like symptoms such as fever, chills and shortness of breath, wheezing and fatigue frequently occur. In fact, Legionnaires Disease is a building related disease caused by bacteria. Studies have shown that work productivity can rise by 15 as much as 10% if the indoor air is clean and healthful. Furthermore, infections caused by bacteria and viruses, such as the coronaviruses, can be severe in certain individuals. Limiting the spread of such viruses is or primary importance, particularly during times of epidemics or pandemics.

Any substance used to treat building air must be safe for the occupants and at the same time have anti-microbial and anti-viral capabilities, which last a relatively long time. Essential oils which are volatile oils distilled or extracted from plants such as thyme, lemongrass, citrus, anise, clove, aniseed, roses, lavender, citronella, cedar leaf, cinnamon leaf, camphor, etc. Such oils have been known for medicinal purposes, as an antiseptic and disinfectant, as an insecticide, for food flavoring and as a solvent. Because of their hydrophobic nature essential oils cannot easily be formulated into aqueous mixtures. U.S. Pat. No. 5,403,587 issued to McCue et al. discloses that such oils can solubilized or dispersed when combined in appropriate amounts with water and a solubilizing or dispersing agent and used for their antimicrobial properties.

Essential oils, particularly essential tree oils, have been found to improve air quality. In particular, cedar leaf oil has been found to provide antimicrobial and antiviral properties. Some references discussing the beneficial properties of cedar leaf oil are listed below, all of which are incorporated herein by reference.

Cedar leaf oil vapor in buildings and forests: Health benefits & mechanisms; Hudson, James B., Journal of Innovations in Pharmaceutical and Biological Sciences (JIPBS), Vol. 6 (4), 33-41, October-December, 2019.

The antimicrobial properties of Cedar Leaf (*Thuja plicata*) oil; A safe and efficient decontamination agent for buildings. Hudson J, Kuo M, and Vimalanathan S. Int J Res Public Health 2011; 8, 4477-4487.

The activity of cedar leaf oil vapor against respiratory viruses: practical applications. Vimalanathan S, and Hudson J: J App Pharm Sci 2013; 11:11-15.

Accordingly, there is a need for a simple, improved apparatus for improving the air quality in a building.

SUMMARY OF THE INVENTION

In some aspects of the present invention there is provided an apparatus for diffusing a vapor from a liquid into an air space, such as for example into airspace of a building using the fresh air make up HVAC system. The apparatus includes an elongate outer tubular member having at least one outer vent opening defined thereon; an elongate inner tubular member received within the outer tubular member for a close rotatable fit therewith, the inner tubular member having at least one inner vent opening defined thereon that may brought into at least partial alignment with the at least one outer vent opening by rotation of the outer tubular member and the inner tubular member relative to each other; a connector portion adjacent one end of the inner tubular member and being operable to removably connect to a liquid container; an elongate cavity defined by the inner tubular member that is open to the connector portion and the container but closed at an opposite closed end; and an elongate wick received in the cavity and extending beyond the connector portion, the wick being operable to transmit by capillary action liquid form the container to the cavity.

The apparatus may include a rotation mechanism operable to rotate one of the outer tubular member and inner tubular member relative to one another between a closed position in which the at least one outer vent opening is not in alignment with the at least one inner vent opening, and an open position in which the at least one outer vent opening is in alignment with the at least one inner vent opening to permit vapor from the liquid in the wick to exit the cavity into the air space. The rotation mechanism may include a projection on one of the inner tubular member and the outer tubular member that is captured within a channel on the other of the inner tubular member and the outer tubular member. The channel may limit a range of motion of the projection to correspond to the open position at one extreme and the closed position at an opposite extreme. The projection may extend from the outer tubular member and the channel may be defined in a flange extending from the inner tubular member.

In some aspect of the present invention there is provided an apparatus for diffusing a vapor from a liquid into an air space. The apparatus includes an elongate outer tubular member having at least one outer vent opening defined in the outer tubular member; an elongate inner tubular member received within the outer tubular member for a close rotatable fit therewith, the inner tubular member: having a first end that extends beyond the outer tubular member and that includes a connector portion that is operable to removably connect to a liquid container, having an second end opposite to the first end, defining an elongate cavity that is open to the connector portion and the container but closed at the second end, having at least one inner vent opening defined thereon that may brought into at least partial alignment with the at least one outer vent opening by rotation of the outer tubular member and the inner tubular member relative to each other. The apparatus also includes an elongate wick received in the cavity and extending beyond the connector portion, the wick being operable to transmit by capillary action liquid form the container to the cavity.

The apparatus may include a rotation mechanism operable to rotate one of the outer tubular member and inner tubular member relative to one another between a closed position in which the at least one outer vent opening is not in alignment with the at least one inner vent opening, and an open position in which the at least one outer vent opening is in alignment with the at least one inner vent opening to permit vapor from the liquid in the wick to exit the cavity into the air space. The at least one outer vent may include a plurality of outer vents spaced around a periphery of the outer tubular member, and the at least one inner vent may include a plurality of inner vents spaced around a periphery of the inner tubular member. The first end may define an elbow that terminates in the connector portion to orient the container perpendicular to the inner tubular member. The rotation mechanism may include a projection on one of the inner tubular member and the outer tubular member that is captured within a channel on the other of the inner tubular member and the outer tubular member. The channel may limit a range of motion of the projection to correspond to the open position at one extreme and the closed position at an opposite extreme. The projection may extend from the outer tubular member and the channel is defined in a flange extending from the inner tubular member adjacent the connector portion. The connector portion may include female threads to accommodate complementary male threads on the container. The projection may extend through the channel beyond the flange to provide a point of coupling to an electric motor thereby enabling the rotation of the outer tubular member to be motorized.

The apparatus may further comprising an electric motor having an output shaft coupled to the rotation mechanism to drive the rotation mechanism. The apparatus may include an electric motor coupled to the projection and is operable to drive the projection through its range of motion within the channel. The apparatus may include a controller operable to control the electric motor in carrying out programmatic instructions. The apparatus may include a sensor operable to measure volatile organic compounds in the air space, and the programmatic instructions are related to the measurements from the senor.

Accordingly, in some aspects of the present invention there is provided an apparatus for improving air quality and reducing microbial and virus levels in the interior of a building, which include a diffuser that holds a wick in its cavity that is fed by a supply of essential oil. The diffuser comprises an outer sleeve or outer tubular member surrounding an inner sleeve or inner tubular member. Both the outer sleeve and the inner sleeve have a plurality of vent openings. The outer sleeve is rotatable relative to the inner sleeve between an open position a close position. In the open position the vent openings on both sleeves are aligned with each other, and in the closed position the vent openings on both sleeves are out of alignment and thus closed. Accordingly, in the open position, the inner vent openings and outer vent openings align to allow air to pass over the wick. The essential oil evaporates and the essential oil vapor travels into the airstream to all parts of the building. The diffuser is scalable and can be produced in larger scale for large buildings. The apparatus may further comprising an electric motor having an output shaft configured to cooperate with the rotation mechanism to drive the rotation mechanism.

The concentration of anti-microbial essential oil may be varied by adjusting the flow of air over the wick by adjusting the relative positions of the outer sleeve and inner sleeve until a desired concentration of anti-microbial essential oil vapor is reached in the air of the room or building.

The anti-microbial essential oil is preferably cedar leaf oil.

In some aspects the present invention may provide a method of diffusing a vapor from a liquid in an air space in a building comprising mounting an apparatus of the present invention into air distribution duct of a commercial HVAC system configured to distribute air into the air space.

BRIEF DESCRIPTION OF THE DRAWINGS

Further features and advantages will be apparent from the following detailed description, given by way of example, of a preferred embodiment taken in conjunction with the accompanying drawings, wherein.

DETAILED DESCRIPTION

Figure 1:
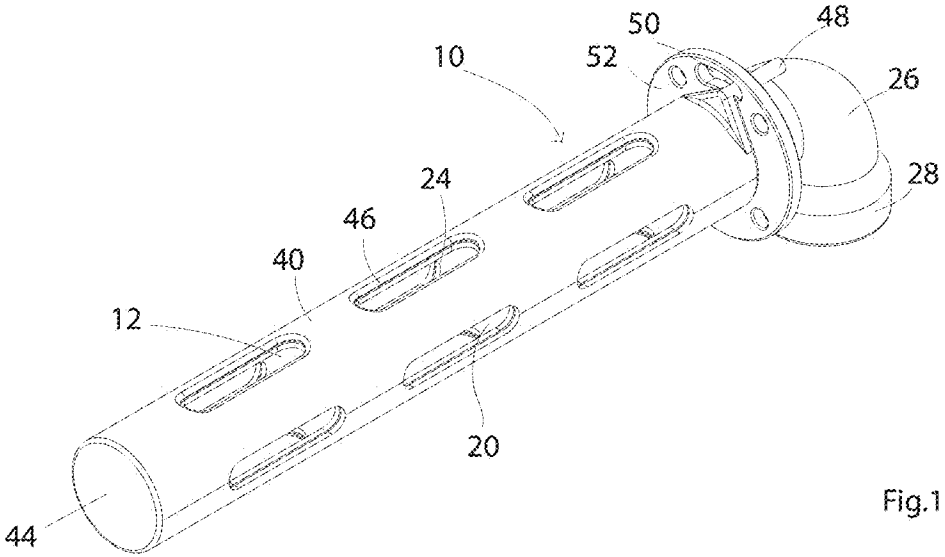
FIG. 1 is a perspective view of an embodiment of a diffuser apparatus in accordance with the present invention.
Figure 2:
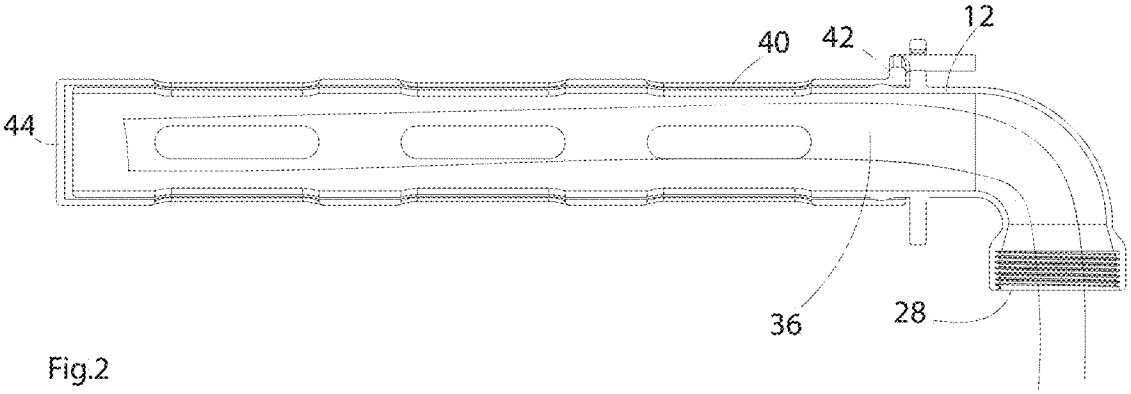
FIG. 2. is a longitudinal section of the diffuser in FIG. 1.
Figure 3:
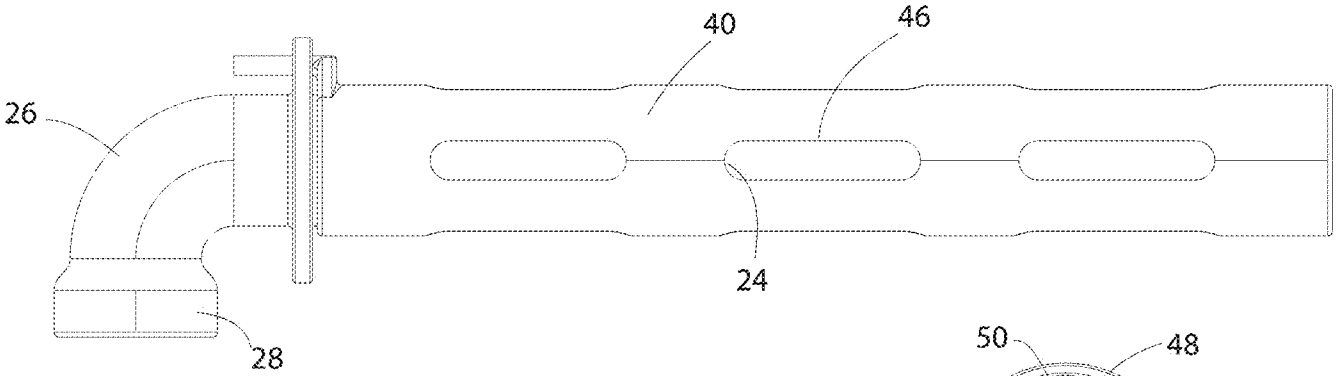
FIG. 3 is a side view of the diffuser in FIG. 1.
Figure 4:
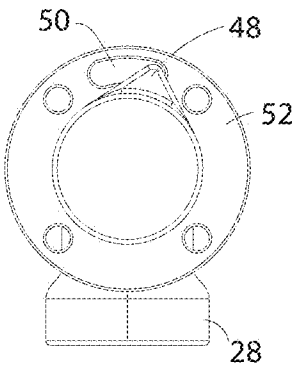
FIG. 4 is a view from one end of the diffuser in FIG. 1.
Figure 5:
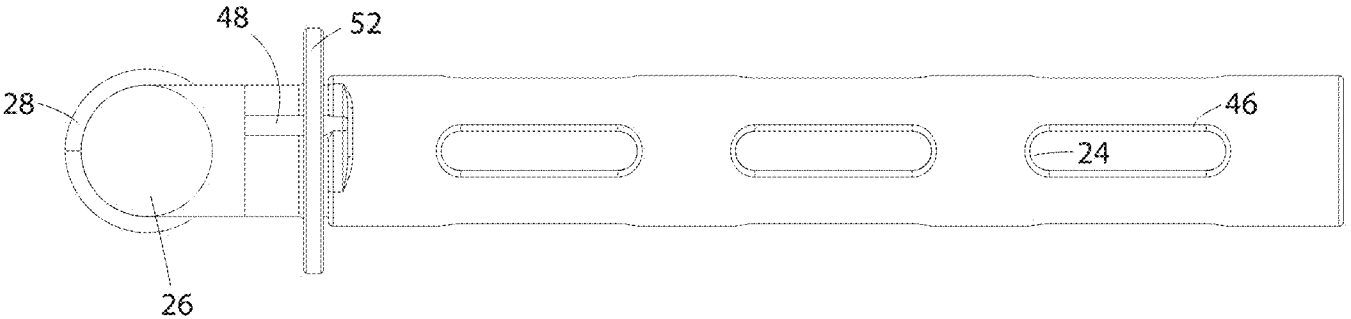
FIG. 5 is a top view of the diffuser in FIG. 1.
Figure 6:
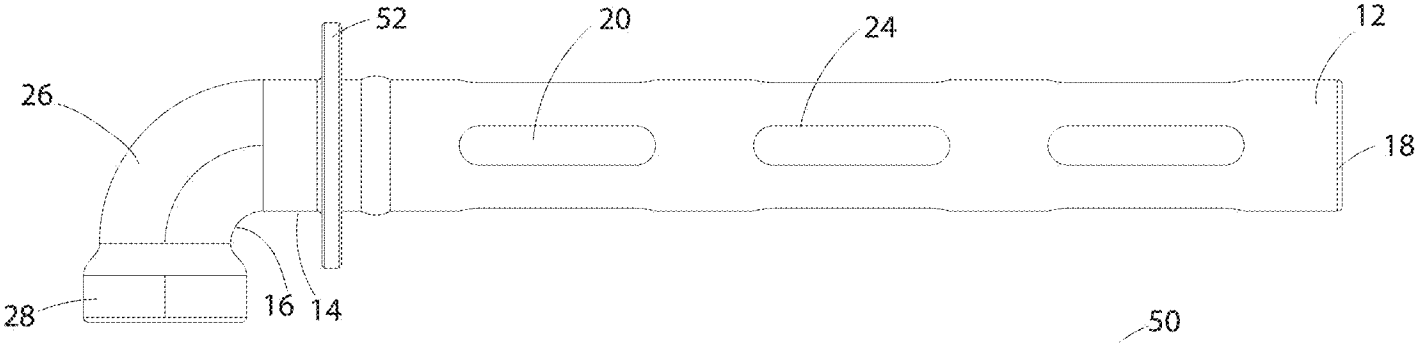
FIG. 6 is a side view of the inner tubular member of the diffuser in FIG. 1.
Figure 7:
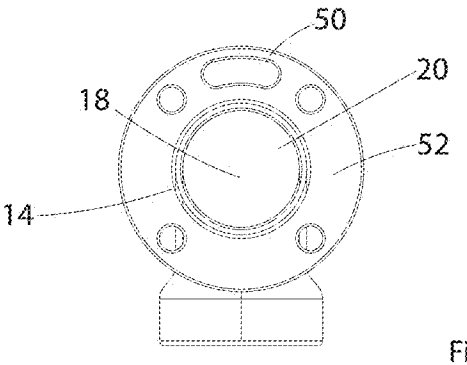
FIG. 7 is a view from one end of the inner tubular member of the diffuser in FIG. 1.
Figure 8:
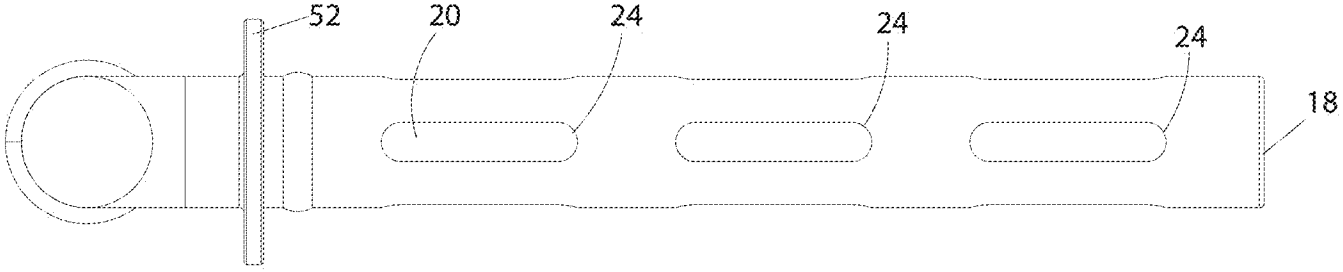
FIG. 8 is a top view of the inner tubular member of the diffuser in FIG. 1.
Figure 9:
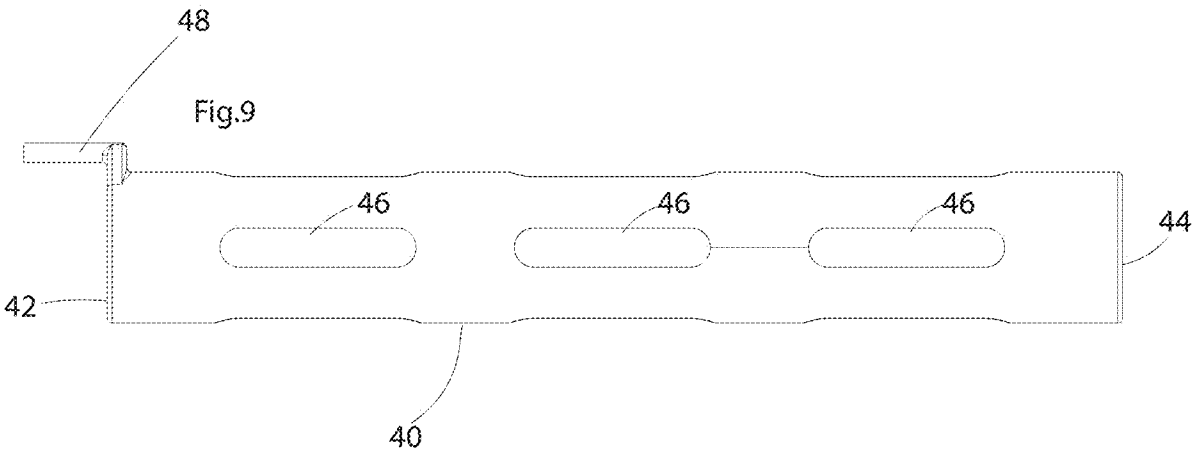
FIG. 9 is a side view of the outer tubular member of the diffuser in FIG. 1.
Figure 10:
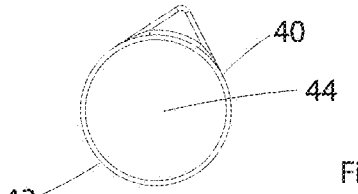
FIG. 10 is a view from one end of the outer tubular member of the diffuser in FIG. 1.
Figure 11:
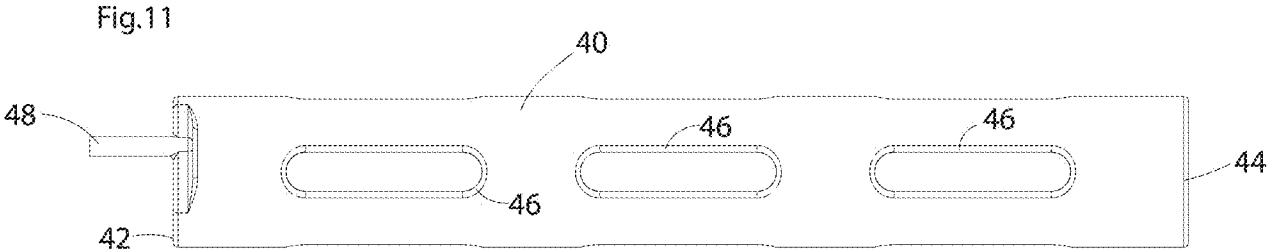
FIG. 11 is a side view of the outer tubular member of the diffuser in FIG. 1.
Figure 12:
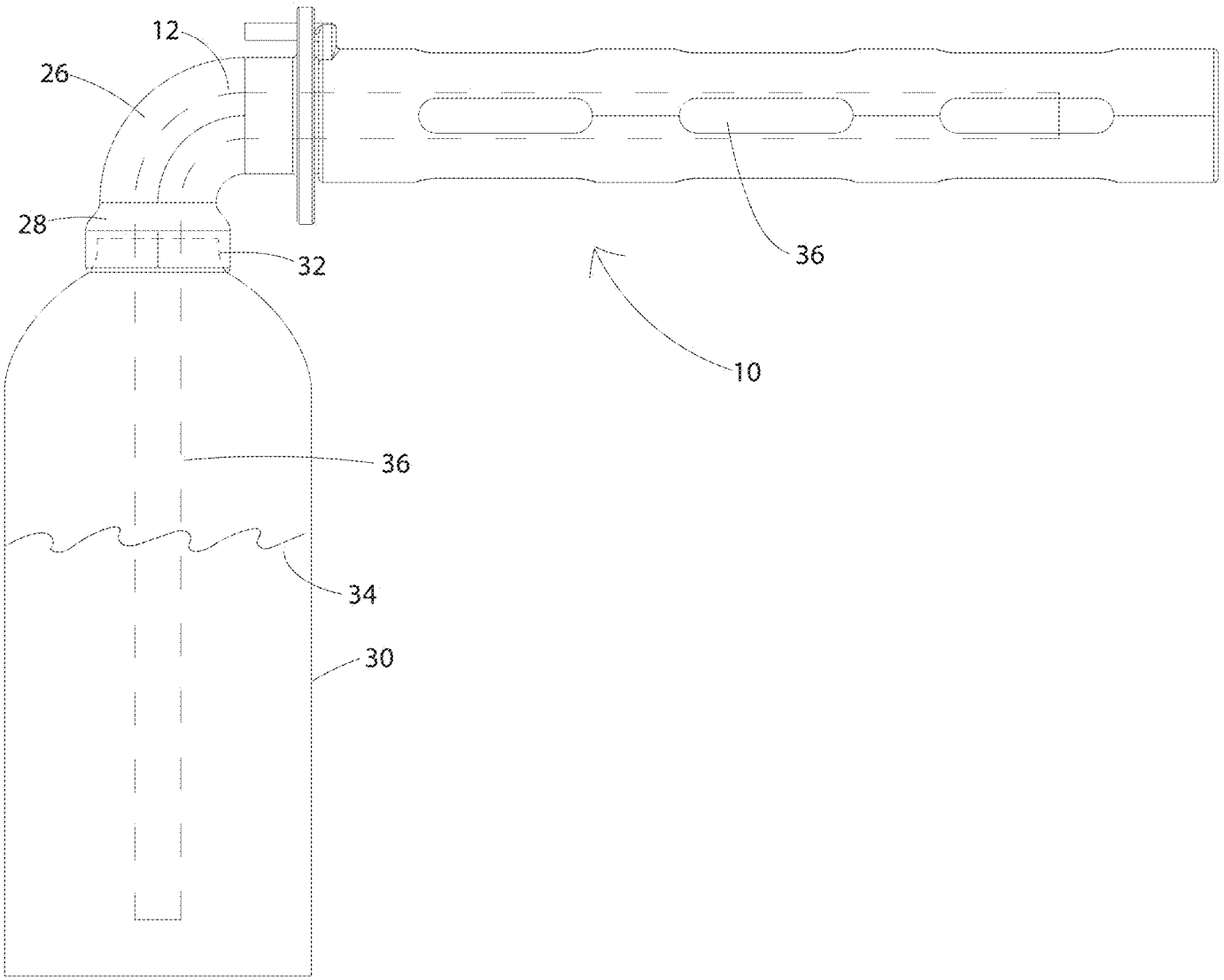
FIG. 12 is a side view of the diffuser in FIG. 1 shown attached to an essential oil container.

Referring to FIGS. 1-13, there is shown an embodiment of a diffuser for improving air quality or disinfecting the air and surfaces in a building in accordance with the present invention and shown as diffuser 10. Diffuser 10 comprises an elongate inner tubular member 12 having a first end 14 with a connector portion 16 and a second end 18 that is opposite the first end 14. Inner tubular member 12 defines an elongate cavity 20 within the wall of the inner tubular member 12, and further includes a plurality of vent openings 24 defined in the inner tubular member 12, preferably spaced apart and around the periphery of the inner tubular member 12. The connector portion 16 in the illustrated embodiment includes an elbow portion 26 and a threaded portion 28 for connecting to a vessel or container 30 having a complementary threaded portion 32. The elbow 26 orients the container 30 to approximately perpendicular to a longitudinal axis of the inner tubular member 12. However, in alternate embodiments of the present invention, the elbow 26 may include a bend that is at any other angle to the inner tubular member 12, or the elbow portion may be omitted altogether such that the container 30 may be in line with the inner tubular member.

The container 30 may be provided with an essential oil 34 and an elongate wick 36 that extends from within the container 30 and into the cavity 20, preferably along the length of the inner tubular member 12. The wick 36 soaks up the essential oil and by capillary action transmits it along its length from the container 30 and along the length of cavity 20. The wick 36 is suited to soaking up essential oils, such as for example a wick made of a wool material. Wicks of this nature are well known in the art. The essential oil in the wick 36 within the cavity 20 vaporizes and diffuses into the air within the cavity. The vaporized essential oil exits the cavity via the vent openings 24 and thereafter is able to diffuse throughout the air in the space surrounding the diffuser 10.

Diffuser 10 further comprises an elongate outer tubular member 40 having a diameter slightly larger than the inner tubular member 12 such that the outer tubular member 40 closely surrounds the inner tubular member 12 and in a manner that enables the outer tubular member to rotate around the inner tubular member. Accordingly, the outer tubular member 40 comprises a sleeve around the inner tubular member 12 that is rotatable about the inner tubular member. The outer tubular member has an open end 42 and a closed end 44 opposite the open end 42. The outer tubular member 40 also includes a plurality of outer vent openings 46 that, in one position of the outer tubular member relative to the inner tubular member, align with the inner vent openings 24 of the inner tubular member 12. This is referred to herein as the open position. In another position of the outer tubular member relative to the inner tubular member, the outer vent openings 46 do not align with the inner vent openings 24 such that the inner vent openings are covered by the material of the outer tubular member, and the outer vent openings are covered by the material of the inner tubular member. This position is referred to herein as the closed position. The outer tubular member 40 is rotatable relative to the inner tubular member between the open position and the closed position.

In the open position, the alignment of the inner vent openings 24 and the outer vent openings 46 enables essential oil vapor to diffuse out of the diffuser 10 via the aligned inner and outer openings into the air space around the diffuser 10 and eventually around the room or rooms in the building. In the closed position, the essential oil vapor is trapped within the cavity 20 as a result of the closed inner vent openings and outer vent openings. In positions in between the open position and closed position, the outer vent openings 46 partially align with the inner vent openings 24, which allows some essential oil vapors to exit the cavity 20. Hence the amount of essential oil vapor exiting form the diffuser may be adjusted by varying the size of the overlap between the inner vent opening and the outer vent openings by rotating the outer tubular member 40 to positions in between the open position and closed position.

In a simplest form, the outer tubular member 40 may be configured to be manipulable by a user to be rotated between the open and closed positions. For example, a grip mechanism may be provided that facilitates being gripped by a hand or fingers of a user.

In the illustrated embodiment, diffuser 10 includes a projection 48 at the open end 42 of the outer tubular member 40 that is received within a channel 50 defined within a circumferential flange 52 at the first end 14 of the inner tubular member 12. Channel 50 defines a range of motion of the projection 48 that at one extreme places the diffuser 10 in the open position and at the other extreme places the diffuser in the closed position. The projection 48 may be connected to an arm or shaft of a motor so that the rotation of the outer tubular member 40 may be controlled by an electric motor. And preferable the motor may be controlled by a controller, such as a programmable logic controller or computer, in response to measured amounts of essential oil vapor in a room obtained by a volatile organic compound (VOC) sensor. Thus, the operation of the diffuser 10, whether it is in open position, closed position, or in between, may be controlled in response to the level of essential oil measured at a location and whether the measurement is below, at, or above a set point.

Figure 13:
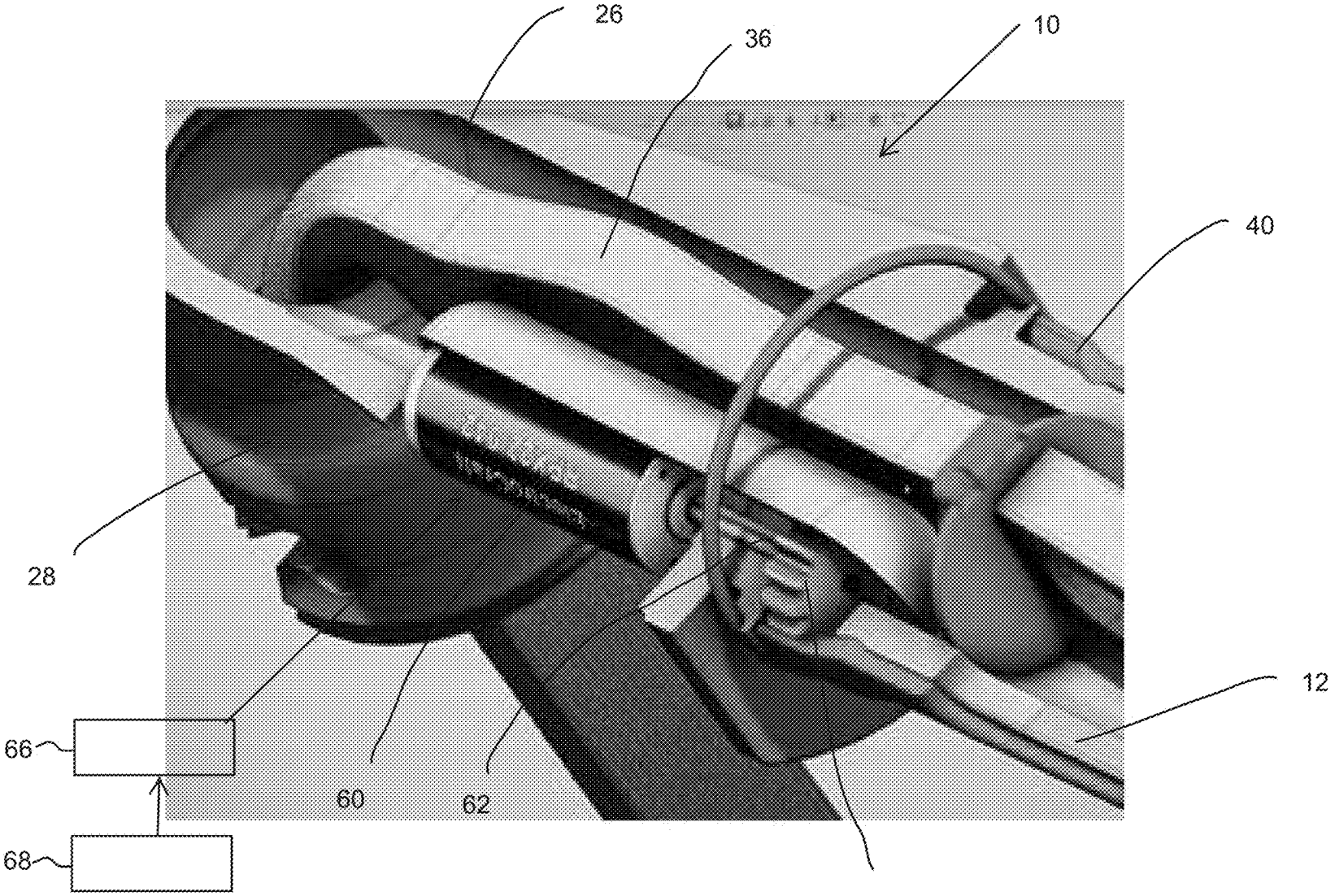
FIG. 13 is a section view of another embodiment of a diffuser of the present invention which is motor driven.

Referring to FIG. 13, there is shown another embodiment of the diffuser 10 that includes a rotation mechanism that is driven by an electric motor 60 having an output shaft 62 that is coupled to the rotation mechanism, which in the illustrated embodiment includes a gear 64 that is coupled to the outer tubular member 40 to drive the rotation of the outer tubular member 40 relative to the inner tubular member 12. The device 10 may further include a controller 66 operable to control the speed and direction of rotation of the electric motor 60 pursuant to programmatic instructions. A sensor 68 may be provided that is operable to measure volatile organic compounds in the air space, and the programmatic instructions are related to the measurements from the senor.

Preferably the essential oil is one that is known to have air cleansing properties, and preferably anti-microbial and/or anti-viral properties. For example, a preferred essential oil is an essential tree oil, and more preferably the essential oil is cedar leaf oil. In preferred embodiments of the present invention, the diffuser 10 distributes cedar leaf oil vapor into the surrounding air and then into the interior of the building where it neutralizes contaminants, micro-organisms and viruses in both the air and on various surfaces.

While the embodiment of the present invention as described and illustrated herein is configured such that the outer tubular member rotates about the inner tubular member to effect open position and the closed position, it will be apparent to the ordinary skilled reader that alternative embodiments of the diffuser could be configured such that the outer tubular member is stationary and connected to container while the inner tubular member is rotatable relative to the outer tubular member. As well, instead of the closed end being provided on the outer tubular member, it may be provided on the inner tubular number. Accordingly, while this invention has been described with reference to illustrative embodiments, this description is not intended to be construed in a limiting sense. Various modifications of the illustrative embodiments, as well as other embodiments of the invention, will be apparent to persons skilled in the art upon reference to this description.

What is claimed is:

1. An apparatus for diffusing a vapor from a liquid into an air space, the apparatus comprising:

a. an elongate outer tubular member having at least one outer vent opening defined thereon;

b. an elongate inner tubular member received within the outer tubular member for a close rotatable fit therewith, the inner tubular member having at least one inner vent opening defined thereon configured to at least partial align with the at least one outer vent opening by rotation of the outer tubular member and the inner tubular member relative to each other;

c. a connector portion adjacent one end of the inner tubular member and being operable to removably connect to a liquid container;

d. an annular flange connected to the inner tubular member adjacent the one end of the inner tubular member;

e. an elbow portion between the connector portion and the annular flange to orient the container when connected to the connector portion at an angle relative to the annular flange wherein the container may be oriented toward a vertical plane when the outer tubular member and inner tubular member are oriented in a horizontal plane;

f. an elongate cavity defined by the inner tubular member that is open to the connector portion and the container but closed at an opposite closed end; and g. an elongate wick received in the cavity and extending beyond the connector portion, the wick being operable to transmit by capillary action liquid form the container to the cavity.

2. The apparatus as claimed in claim 1, further comprising a rotation mechanism operable from an elbow-side of the annular flange to rotate the outer tubular member relative to the inner tubular member between a closed position in which the at least one outer vent opening is not in alignment with the at least one inner vent opening, and an open position in which the at least one outer vent opening is in alignment with the at least one inner vent opening to permit vapor from the liquid in the wick to exit the cavity into the air space.

3. The apparatus as claimed in claim 2, wherein the rotation mechanism comprises a projection on one of the inner tubular member and the outer tubular member that is captured within a channel that limits a range of motion of the projection to correspond to the open position at one extreme and the closed position at an opposite extreme.

4. The apparatus as claimed in claim 2, wherein the rotation mechanism comprises a projection on the outer tubular member extending to the elbow-side of the annular flange and that is captured within a channel that limits a range of motion of the projection to correspond to the open position at one extreme and the closed position at an opposite extreme.

5. The apparatus as claimed in claim 4, wherein the channel is defined in the annular flange.

6. The apparatus as claimed in claim 1, further comprising a rotation mechanism operable to rotate the outer tubular member relative to the inner tubular member between a closed position in which the at least one outer vent opening is not in alignment with the at least one inner vent opening, and an open position in which the at least one outer vent opening is in alignment with the at least one inner vent opening to permit vapor from the liquid in the wick to exit the cavity into the air space; and an electric motor having an output shaft coupled to the rotation mechanism to drive the rotation mechanism.

7. An apparatus for diffusing a vapor from a liquid into an air space, the apparatus comprising:

a. an elongate outer tubular member having at least one outer vent opening defined in the outer tubular member;

b. an elongate inner tubular member received within the outer tubular member for a close rotatable fit therewith, the inner tubular member:

i. having a first end that extends beyond the outer tubular member and that includes a connector portion that is operable to removably connect to a liquid container, wherein the first end defines an elbow portion that terminates in the connector portion to orient the container at an angle to the inner tubular member wherein the container may be oriented toward a vertical plane when the inner tubular member is oriented in a horizontal plane;

ii. having an annular flange connected to the inner tubular member adjacent the elbow portion;

iii. having a second end opposite to the first end, iv. defining an elongate cavity that is open to the connector portion and the container but closed at the second end, and v. having at least one inner vent opening defined thereon configured to at least partial align with the at least one outer vent opening by rotation of the outer tubular member and the inner tubular member relative to each other; and c. an elongate wick received in the cavity and extending beyond the connector portion, the wick being operable to transmit by capillary action liquid form the container to the cavity.

8. The apparatus as claimed in claim 7, further comprising a rotation mechanism operable from an elbow-side of the annular flange to rotate one of the outer tubular member relative to the inner tubular member between a closed position in which the at least one outer vent opening is not in alignment with the at least one inner vent opening, and an open position in which the at least one outer vent opening is in alignment with the at least one inner vent opening to permit vapor from the liquid in the wick to exit the cavity into the air space.

9. The apparatus as claimed in claim 8, wherein the at least one outer vent comprises a plurality of outer vents spaced around a periphery of the outer tubular member, and the at least one inner vent comprises a plurality of inner vents spaced around a periphery of the inner tubular member.

10. The apparatus as claimed in claim 8, wherein the rotation mechanism comprises a projection on the outer tubular member extending to the elbow-side of the annular flange that is captured within a channel that limits a range of motion of the projection to correspond to the open position at one extreme and the closed position at an opposite extreme.

11. The apparatus as claimed in claim 10, wherein the channel is defined in the flange.

12. The apparatus as claimed in claim 11, wherein the connector portion includes female threads to accommodate complementary male threads on the container.

13. The apparatus as claimed in claim 12, further comprising an electric motor coupled to the projection and is operable to drive the projection through its range of motion within the channel.

14. The apparatus as claimed in claim 13, further comprising a controller operable to control the electric motor in carrying out programmatic instructions.

15. The apparatus as claimed in claim 14 further comprising a sensor operable to measure volatile organic compounds in the air space, and the programmatic instructions are related to the measurements from the sensor.

16. The apparatus as claimed in claim 11, wherein the projection provides a point of coupling to an electric motor thereby enabling the rotation of the outer tubular member to be motorized.

17. The apparatus as claimed in claim 7, further comprising a rotation mechanism operable to rotate the outer tubular member relative to the inner tubular member between a closed position in which the at least one outer vent opening is not in alignment with the at least one inner vent opening, and an open position in which the at least one outer vent opening is in alignment with the at least one inner vent opening to permit vapor from the liquid in the wick to exit the cavity into the air space; and an electric motor having an output shaft configured to cooperate with the rotation mechanism to drive the rotation mechanism.

18. A method of diffusing a vapor from a liquid in an air space in a building comprising mounting an apparatus comprising:

An elongate outer tubular member having at least one outer vent opening defined thereon;

An elongate inner tubular member received within the outer tubular member for a close rotatable fit therewith, the inner tubular member having at least one inner vent opening defined thereon configured to at least partial align with the at least one outer vent opening by rotation of the outer tubular member and the inner tubular member relative to each other;

A connector portion adjacent one end of the inner tubular member and being operable to removably connect to a liquid container;

An annular flange connected to the inner tubular member adjacent the one end of the inner tubular member;

An elbow portion between the connector portion and the annular flange to orient the container when connected to the connector portion at an angle relative to the annular flange wherein the container may be oriented toward a vertical plane when the outer tubular member and inner tubular member are oriented in a horizontal plane;

An elongate cavity defined by the inner tubular member that is open to the connector portion and the container but closed at an opposite closed end; and An elongate wick received in the cavity and extending beyond the connector portion, the wick being operable to transmit by capillary action liquid from the container to the cavity, into an air distribution duct of a commercial HVAC system configured to distribute air into the air space.

* * * * *